United States Patent [19]

Epper et al.

[11] Patent Number: 4,898,571

[45] Date of Patent: Feb. 6, 1990

[54] SOLID BOWL CENTRIFUGE

[75] Inventors: Wolfgang Epper, Bergheim-Kenten; Hans-H. Gildemeister, Overath, both of Fed. Rep. of Germany

[73] Assignee: Klöckner-Humboldt-Deutz Aktiengesellschaft, Fed. Rep. of Germany

[21] Appl. No.: 277,978

[22] Filed: Nov. 30, 1988

[30] Foreign Application Priority Data

Dec. 24, 1987 [DE] Fed. Rep. of Germany ..... 3744093

[51] Int. Cl.[4] ..... B04B 3/02; B04B 11/08

[52] U.S. Cl. ..... 494/26; 494/37; 494/55; 494/58

[58] Field of Search ..... 494/26, 37, 52, 53, 494/54, 55, 56, 57, 58, 59, 85, 44; 210/781, 782, 360.1

[56] References Cited

U.S. PATENT DOCUMENTS 3,885,734 5/1975 Lee ..... 494/53

4,790,806 12/1988 High ..... 494/56

*Primary Examiner*—Robert W. Jenkins

*Attorney, Agent, or Firm*—Hill, Van Santen, Steadman & Simpson

[57] ABSTRACT

A method and apparatus for separating mixtures of different densities into a lighter phase and a heavier phase including a rotary drum providing a cylindrical settling sump at the outer wall, a displacement member rotatably located within the drum forming a settling sump between the displacement member and the drum wall, a discharge element for lighter phase material spaced radially inwardly from the settling sump, a discharge conductor for heavier phase material leading from the settling sump at the deepest location at the outer circumference of the drum, and a compressed air conduit connected to the discharge for heavier phase material aiding in the removal thereof, and vanes on the displacement member aiding in movement of the material through the drum.

15 Claims, 2 Drawing Sheets

13
43b
41b
19
42b
16
8
8
14
15
37a
37b
18
17
52
4
9
8a
18
X
β
5
α1
α2
6
40
22
10
5
3
20
1
X
21a
21b
2
45
45
51
12
42a
26
25
41a
43a
44

SOLID BOWL CENTRIFUGE

BACKGROUND OF THE INVENTION

The invention relates to a solid bowl centrifuge, particularly for separating agents of different density or mixtures thereof and/or suspensions that are difficult to separate into a comparatively lighter and at least one heavier phase.

More particularly, the invention relates to a method and apparatus including a drum seated rotatably on a shaft and forming a settling sump therein and elements for the admission of the agents to be separated and for discharging the separated phases. Centrifuges of this type are disclosed, for example, by German published application No. 33 17 047 wherein a displacement member extending in the direction of the rotational axis and seated rotatably with a hollow shaft is arranged along the settling sump at a distance from the inside wall of the drum, and the centrifuge is constructed with means for operation in cocurrent flow, whereby the admission element for the medium to be separated is arranged at the intake region of the settling sump and the discharge elements for the separated phases are arranged departing from the outlet region thereof.

Although the technical field involving centrifuges represents a technology that has been known, the increasing utilization of microbiology for processing waste water and/or liquid manure, for example, makes constantly increasing demands of the separating capability of centrifuges, since the gel-like sludge that thereby arises resists sedimentation and thus presents great difficulties in the phase separation.

Different methods and apparatus have been disclosed for dewatering such predominantly viscous sludges, but these have not yet been capable of resolving the problem in a satisfactory manner.

For example, German utility model No. 84 60 004.7 proposes an overflow separation centrifuge for separating treatment of sludge that comprises a liquid discharge pipe that projects into the drum and has a peeling spout at its free end, with the peeling spout being adjustable for skimming a phase in differing depth of the sedimentation pond. Such an apparatus is extremely difficult to operate and is also susceptible to malfunction.

Another centrifuge disclosed by German publication application No. 26 51 657 has a purified liquid overflow at a location between admission and solids discharge, whereby the overflow element is composed of a plurality of small pipes projecting radially into the clarifying chamber from the outside toward the inside. The height of damming can thereby be set in that the small pipes are allowed to project into the clarifying chamber to a greater or lesser distance.

Disadvantageously, energy is lost in this structure with the peripherally discharged purified phase and the liquid that has been centrifuged out produces an extremely undesirable frothing. Foam-inhibiting agents must be utilized on a case-by-case basis for combatting this and these incur costs and also contaminate the purified phase. This known apparatus also does not prove satisfactory in resolving the stated problem.

German published application No. 33 17 047 has proposed a solid bowl worm centrifuge for this purpose having a cylindrical structure for parting suspensions that are difficult to separate. This worm centrifuge has a parting disk at the end of the separating chamber and includes purified phase channels arranged preceding the parting disk and sediment channels arranged following the parting disk. Both discharges lead out of the centrifuge drum in the region of the center of said centrifuge drum. A measuring cell for identifying the content of dry matter is arranged in the sediment discharge and controls a quantity regulating element in the purified phase discharge conduit based on the measure of the constant solids content in the sediment.

The known apparatus requires delivery of the suspension with pressure between 0.4 through 0.6 MPa and thus requires a sealing of the bearings.

Such seals are extremely complex in structure. They are also difficult to maintain, are extremely susceptible to wear and, thus, susceptible to malfunction. This known centrifuge also is not technologically satisfactory.

An object of the invention is to provide a centrifuge of the species referred to wherein the phase separating of agents that are difficult to separate, for example, sewage treatment sludges, is possible while largely avoiding energy losses and without a complicated structure of the centrifuge.

Another object is to provide a centrifuge which avoids pressurized operation and employs a simple control of the solids contents in different phases that contain solids, and which can be erected with optimally little outlay for manufacturing, assembly and maintenance costs and can be operated with an economical energy expenditure.

FEATURES OF THE INVENTION

Advantageously, what is achieved by the synergistic interaction of the inventive features is that an exact management of the suspension to be separated is achieved in view of maximum separation effect given cocurrent flow operation. What the arrangement of the displacement member achieves is that a large surface of the settling sump that corresponds to the diameter of the displacement member is preserved in the sedimentation region. This is in contrast to where the admission as well as the discharge region of the agents are allocated relatively close to the center of rotation. Drive energy is thereby saved and an energetically beneficial operation is guaranteed.

The arrangement of a conveying element in the discharge element for the sedimentation phase does not require pressurized operation, and it therefore avoids seals and the maintenance problems thereof and it is extremely economical as seen from the standpoint of the energy expenditure required.

The development provides that the conveying means is constructed as a compressed air liquid lifter which may be referred to as a mammoth pump and the conveyor is connected to a compressed air conduit conducted through the hollow shaft into the interior of the drum.

The compressed air liquid lifter advantageously comprises an extremely simple embodiment, does not require any moving parts, is uncomplicated, is efficient in terms of its conveying effect and is controllable within prescribed limits, particularly with respect to the conveying capacity.

Other advantages, objects and features will become more apparent with the teaching of the principles of the invention in connection with the disclosure of the preferred embodiments in the specification, claims and drawings, in which:

DESCRIPTION OF THE PREFERRED EMBODIMENTS

Figure 1:
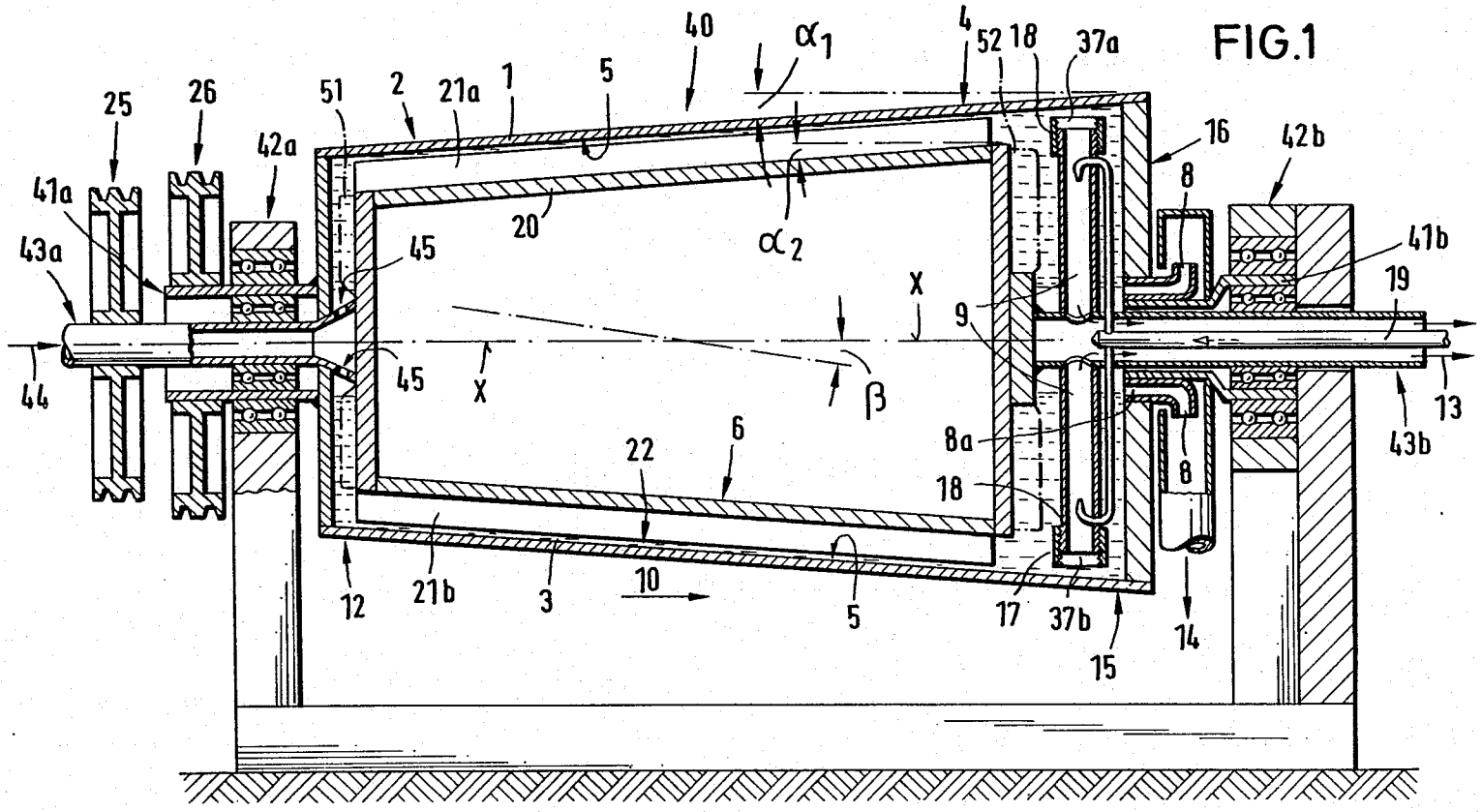
FIG. 1 is a vertical sectional view taken through a rotary solid bowl centrifuge constructed and operating in accordance with the principles of the present invention.

FIG. 1 shows a solid bowl centrifuge 40 comprising a frusto conically shaped drum 2 seated on hollow shafts 41*a*, 41*b* at both sides in bearing blocks 42*a*, 42*b* supported on end columns of a framework. Dipping into a settling sump 3, a hollow frusto conical shaped displacement member 6 is situated in the interior of the drum 2. This displacement member 6 is likewise rotatably seated at both ends on hollow shafts 43*a* and 43*b* in the bearing blocks 42*a* and 42*b*. A suspension is supplied to the centrifuge 40 through the hollow shaft 43*a*, as indicated by an arrow 44. The suspension 44 emerges through radial openings 45 in the hollow shaft 43 and proceeds into the interior of the drum 2 and forms the settling sump 3 there during operation.

The hollow shaft 41*a* of the drum 2 includes a V-belt pulley 26 to drive it and the hollow shaft 43*a* of the displacement member includes a V-belt pulley 25 to drive it. In accord with FIG. 2, these form a differential V-belt drive 24 for the centrifuge 40 in interaction with a V-belt pulley 27 of a drive motor 28.

The bowl 1 of the drum 2 is preferably constructed with a conically shaped expansion wall 4 expanding in a flow-through direction 10 of the settling sump 3. As a result, the suspension entering at the left side through the openings 45 according to FIG. 1 is given an accelerating component in the artificial gravitational field for the particles of the heavier phase in flow-through direction 10. As may be seen, the particles strive to migrate toward the right in the settling sump 3 toward the region of the largest drum diameter and to thereby settle. The centrifuge 40 operates in co-current flow while observing optimum conditions of separating effect, whereby the displacement member 6, formed as a smooth truncated cone, does not cause disturbing eddies or a counter-current flow field at any location of the settling sump 3.

As FIG. 1 further shows, a discharge element 8 for the light phase 14 is conducted to an overflow 8*a* at the face wall 16 of the drum and a discharge element 9 for the heavier phase 13 is arranged proceeding from the lowest region 17 of the settling sump 3 has a conveying means 18, and discharges into a hollow shaft 43*b*.

This conveying means 18 is constructed as a compressed air liquid lifter 37*a*, 37*b* and is connected to a compressed air conduit 19 conducted into the interior of the drum 2 through the hollow shaft 43*b*.

The arrangement is surprisingly simple but is both functionally reliable and energetically economical.

Advantageously, the conical expansion 4 of the bowl 1 of the drum 2 is constructed with a cone angle $\alpha_1$ between 1° and 8°, preferably between 3° and 5° and the displacement member 6 is constructed with a dynamically balanced jacket 20 in the form of a truncated cone having a cone angle $\alpha_2$ that essentially corresponds to the cone angle $\alpha_1$ of the drum bowl 1.

In the region of the displacement member 6 is the settling sump 3 having a comparatively large surface with sedimentation conditions having optimum parameters thus resulting.

An expedient development of the centrifuge further provides that the displacement member 6 includes raker elements 21*a* and 21*b*.

It is known that deposits of solids that complicate or prevent the flowability of the heavier phase 13 in the direction 10 to the deepest region 17 of the settling sump 3 can occur at the inside wall 5 of the bowl 1 in a solid bowl centrifuge. Such formations of cakes tend to especially occur in the dewatering of viscous, pasty sludges, particularly sewage treatment plant sludges.

In the embodiment shown by way of example, the raking elements 21*a* and 21*b* are two raking ledges that reside opposite one another on the jacket 20. The solids arising in the region of the inner drum wall 5 during the separation of the solids/liquid mixture are kept in motion as a result of the these raker ledges, so that they cannot adhere.

Each raker element 21*a*, 21*b* can be formed as a helix with very large pitch having a helix angle $\beta$ between 0 and 10°, preferably between 3 and 5° relative to the rotational axis x—x of the system. This promotes the conveying of the solids in the centrifuge bowl 2 to the solids discharge end 15 and makes it more uniform.

By contrast to a solids conveying on the basis of a worm screw, the low difference in rotational speed between the displacement member 6 including raker elements 21*a*, 21*b* and the bowl 2 advantageously requires only a negligibly small amount of drive energy.

This drive can therefore be fashioned in an simple way, preferably as a V-belt drive.

In the system of this V-belt drive 24, the hollow shaft 43*a* of the displacement member 6 includes the first V-belt pulley 25 and the hollow drive shaft 41*a* of the bowl 2 includes the second V-belt pulley 26. In cooperation with the V-belt pulley 27 of the shared drive motor 28, these yield a predetermined difference in rotational speed between bowl 2 and displacement member 6 given appropriate dimensioning, see FIG. 2.

A further reduction in the required drive power for the system of the centrifuge 40 can also be additionally achieved in that flow guidance elements 51, 52, for example in the form of curved paddles in the form of a radial pump or, radial turbine wheel. These are arranged in the interior of the bowl 2, converting kinetic energy into potential energy and vice-versa. This arrangement improves the efficient operation of the centrifuge.

Figure 2:
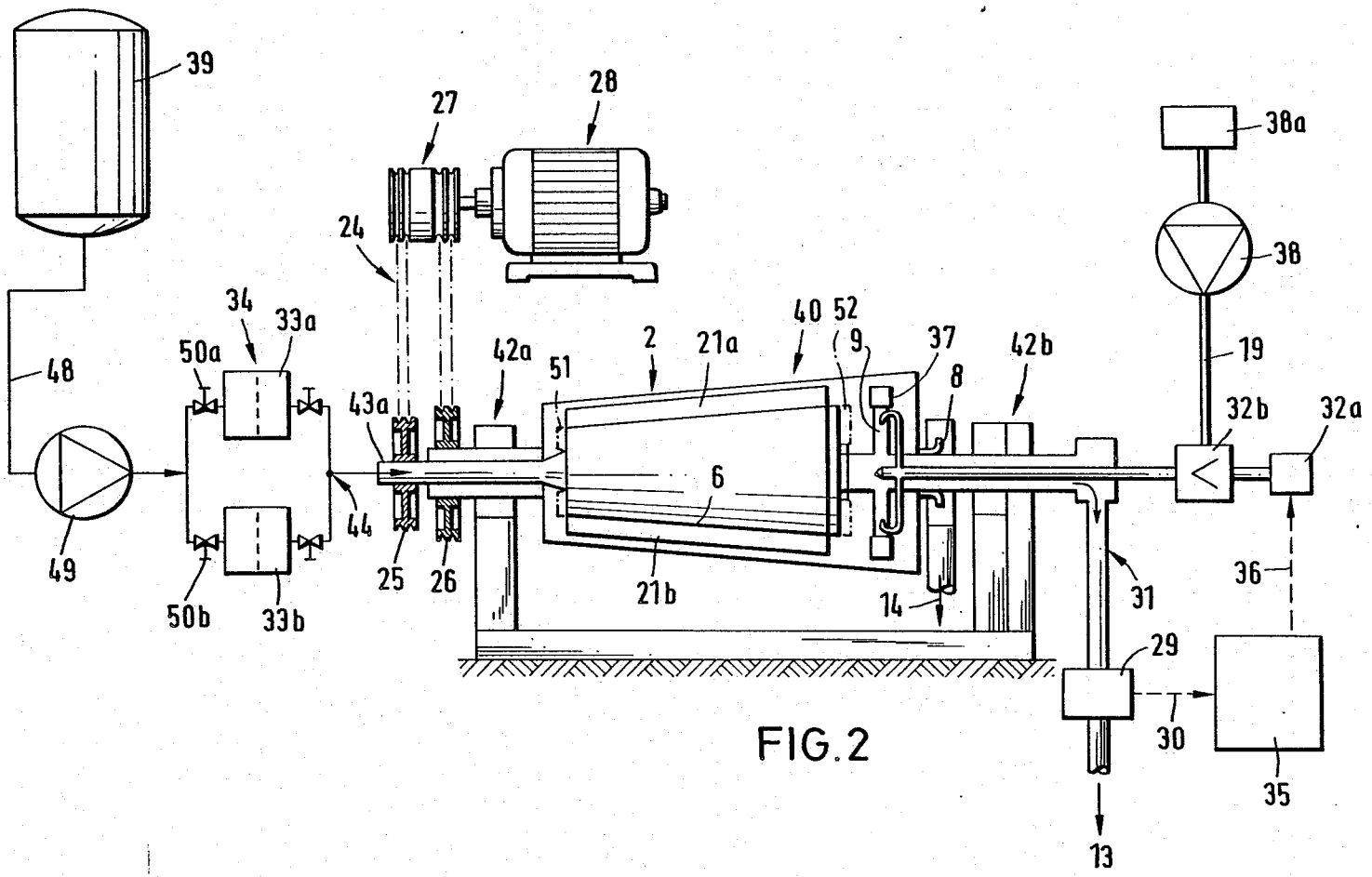
FIG. 2 is a schematic diagram illustrating the centrifuge used in a sludge densifying system.

As may be seen from the schematic method diagram of a densifier system according to FIG. 2 this includes a solid bowl centrifuge 40 and a measuring means 29 for calculating the solids content flowing to the discharge 31 and out the heavier phase line 13. This measurement can be transmitted via a signal line 30 as well as a computer unit 35 and then to a control line 36 leading to a quantity-regulating mechanism 32*a* and 32*b* in the compressed air conduit 19 of the compressed air liquid lifter 37. The air conduit is connected via the control line 36 to the actuating element 32*a* of the quantity regulator 32*b* for the compressed air. The compressed air generating system comprises a compressed air pump 38 with motor 38*a*. Via the control means 29, 35 and 32, the discharged quantity of the solids-enriched phase 13 is influenced based on the measure of a prescribed conveying characteristic of the compressed air liquid lifter 37 so that the solids content remains constant.

A coarse materials separator 34 precedes the admission elements 43a and 45. This coarse materials separator 34 comprises two units 33a and 33b in parallel. For example, the suspension 44 is supplied into the centrifuge 40 from a reservoir 39 with a conduit 48, being supplied by a conveying pump 49 and a switchable valve assembly 50a and 50b through a filter 33a or filter 33b. The arrangement enables a reciprocal operation whereby the filter that is respectively not in operation can b cleaned without interrupting operations and can then be re-stored into the admission conduits.

WE CLAIM AS OUR INVENTION

1. A solid bowl centrifuge for separating mixtures including different densities into a lighter phase and a heavier phase comprising in combination:

a rotary drum providing a cylindrical settling sump therein and having an inlet for a mixture to be separated and having end walls;

a displacement member rotationally located within the drum having end walls and forming the settling sump between the displacement member and the drum;

means defining a discharge element for lighter phase material in an end wall of the drum;

means defining a discharge element for heavier phase material leading from the settling sump at the deepest location at the outer circumference of the drum;

and a hollow shaft on the displacement member connected to said heavier discharge element for the removal of heavier phase material.

2. A solid bowl centrifuge for separating mixtures including different densities into a lighter phase and a heavier phase constructed in accordance with claim 1:

wherein the drum is conically shaped expanding in the direction of material flow through the settling sump.

3. A solid bowl centrifuge for separating mixtures including different densities into a lighter phase and a heavier phase constructed in accordance with claim 1:

including a compressed air conduit extending through said hollow shaft to the interior of the drum and connected to the discharge element for the heavier phase material so that the structure acts as a mammoth pump with the compressed air providing a liquid lifter.

4. A solid bowl centrifuge for separating mixtures including different densities into a lighter phase and a heavier phase constructed in accordance with claim 3:

wherein the compressed air liquid lifter is led into an upstream portion of the discharge element for the heavier phase material.

5. A solid bowl centrifuge for separating mixtures including different densities into a lighter phase and a heavier phase constructed in accordance with claim 1:

wherein each of the rotary drum and displacement member are conically shaped with the cone angle of each lying between 1° and 8°.

6. A solid bowl centrifuge for separating mixtures including different densities into a lighter phase and a heavier phase constructed in accordance with claim 1:

wherein the displacement member carries generally axially extending raker elements which have a large pitch helix angle between 0° and 10°.

7. A solid bowl centrifuge for separating mixtures including different densities into a lighter phase and a heavier phase constructed in accordance with claim 1:

including drive means connected to the rotary drum and to the displacement member and driving the displacement member at a different speed of rotation than the rotary drum.

8. A solid bowl centrifuge for separating mixtures including different densities into a lighter phase and a heavier phase constructed in accordance with claim 1:

including compressed air means connected to the discharge element for heavier phase material aiding in the flow from the drum;

and means measuring the rate of flow discharge of the heavier phase material and controlling the supply of compressed air.

9. A solid bowl centrifuge for separating mixtures including different densities into a lighter phase and a heavier phase constructed in accordance with claim 1:

including a separator connected to said inlet removing coarse materials prior to the mixture entering the drum.

10. A solid bowl centrifuge for separating mixtures including different densities into a lighter phase and a heavier phase comprising in combination:

a first conically shaped rotary drum having an outer wall and end walls and providing a settling sump therein at a larger end of the outer wall of the drum;

a first outlet conduit for lighter phase material communicating with the interior of the drum displaced radially inwardly from the outer drum wall;

a second outlet conduit for heavier phase material communicating with the interior of the drum at the settling pump;

a compressed air conduit connected to the second outlet and aiding in the removal of heavier phase material;

and means for measuring the flow of heavier phase material and controllably connected to the compressed air conduit regulating the flow of air as a function of the flow of heavier phase material.

11. A solid bowl centrifuge for separating mixtures including different densities into a lighter phase and a heavier phase comprising in combination:

a first conically shaped rotary drum having an outer wall and end walls and providing a settling sump therein at a larger end of the outer wall of the drum;

a first outlet conduit for lighter phase material communicating with the interior of the drum displaced radially inwardly from the outer drum wall;

a second outlet conduit for heavier phase material communicating with the interior of the drum at the settling pump;

a compressed air conduit connected to the second outlet and aiding in the removal of heavier phase material;

the outlet for heavier phase material including a radial passage extending radially inwardly from the settling sump;

and the air conduit including a compressed air jet projecting radially inwardly in said second outlet conduit for aiding in the flow of heavier phase material.

12. A solid bowl centrifuge for separating mixtures including different densities into a lighter phase and a heavier phase comprising in combination:

a first conically shaped rotary drum having an outer wall and end walls and providing a settling sump therein at a larger end of the outer wall of the drum;

a first outlet conduit for lighter phase material communicating with the interior of the drum displaced radially inwardly from the outer drum wall;

a second outlet conduit for heavier phase material communicating with the interior of the drum at the settling pump;

a compressed air conduit connected to the second outlet and aiding in the removal of heavier phase material;

and a displacement member within the rotary drum having an outer wall extending substantially parallel to the outer wall of the rotary drum for defining the settling sump therebetween.

13. A solid bowl centrifuge for separating mixtures including different densities into a lighter phase and a heavier phase constructed in accordance with claim 12:

wherein said displacement member carries material advancing raker elements on the outer surface of the outer wall.

14. A solid bowl centrifuge for separating mixtures including different densities into a lighter phase and a heavier phase constructed in accordance with claim 12:

including end fins on at least one end of the displacement member.

15. The method of separating mixtures including different densities into a lighter phase and a heavier phase between the surface walls of a rotary drum and a displacement member within the drum defining a settling sump therebetween, the method including:

providing an outlet for heavier phase materials from the sump and utilizing compressed air for aiding in the flow of heavier materials from the sump, and regulating the flow of compressed air as a function of flow of heavier phase materials.

* * * * *